US007159662B2

(12) United States Patent
Johansen et al.

(10) Patent No.: US 7,159,662 B2
(45) Date of Patent: Jan. 9, 2007

(54) SYSTEM FOR CONTROLLING A HYDRAULIC ACTUATOR, AND METHODS OF USING SAME

(75) Inventors: John A. Johansen, Kongsberg (NO); Vidar Sten Halvorsen, Kongsberg (NO); Michael R. Williams, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 115 days.

(21) Appl. No.: 10/780,969

(22) Filed: Feb. 18, 2004

(65) Prior Publication Data

US 2005/0178560 A1 Aug. 18, 2005

(51) Int. Cl.
*E21B 34/10* (2006.01)

(52) U.S. Cl. ..... 166/374; 166/319

(58) Field of Classification Search ..... 166/374, 166/319, 373

See application file for complete search history.

(56) References Cited

U.S. PATENT DOCUMENTS

| | | | | |
|---|---|---|---|---|
| 4,095,421 | A * | 6/1978 | Silcox | 60/398 |
| 4,185,652 | A * | 1/1980 | Zintz et al. | 137/78.2 |
| 4,240,463 | A | 12/1980 | Moore | |
| 4,817,669 | A * | 4/1989 | Barrier et al. | 137/627.5 |
| 4,920,811 | A | 5/1990 | Hopper | |
| 5,195,721 | A | 3/1993 | Akkerman | |
| 5,497,672 | A | 3/1996 | Appleford et al. | |
| 5,519,295 | A | 5/1996 | Jatnieks | |
| 6,053,202 | A * | 4/2000 | Cunningham | 137/596.16 |
| 6,192,680 | B1 * | 2/2001 | Brugman et al. | 60/398 |
| 6,202,753 | B1 | 3/2001 | Baugh | |
| 6,250,199 | B1 | 6/2001 | Schulte et al. | |
| 6,269,874 | B1 | 8/2001 | Rawson et al. | |
| 6,595,487 | B1 | 7/2003 | Johansen et al. | |
| 6,702,025 | B1 | 3/2004 | Meaders | |
| 2003/0230190 | A1 | 12/2003 | Douglas | |

FOREIGN PATENT DOCUMENTS

| | | |
|---|---|---|
| EP | 0 984 133 A1 | 3/2000 |
| EP | 1 209 294 A2 | 5/2002 |
| EP | 1 241 322 A1 | 9/2002 |
| GB | 2 216 570 A | 10/1989 |
| NO | 309737 | 9/1999 |
| WO | WO 95/08715 | 3/1995 |
| WO | WO 01/12950 A1 | 2/2001 |

OTHER PUBLICATIONS

PCT Search Report, International Application No. PCT/US05/04766, dated Apr. 10, 2006.

* cited by examiner

*Primary Examiner*—Kenneth Thompson
(74) *Attorney, Agent, or Firm*—Williams, Morgan & Amerson, P.C.

(57) ABSTRACT

The present invention is directed to a system for controlling a hydraulic actuator, and various methods of using same. In one illustrative embodiment, the system comprises a first hydraulic cylinder, an isolated supply of fluid provided to the first hydraulic cylinder, the isolated supply of fluid positioned in an environment that is at a pressure other than atmospheric pressure, an actuator device coupled to the first hydraulic cylinder, the actuator device adapted to drive the first hydraulic cylinder to create the sufficient pressure in the fluid, and at least one hydraulic line operatively intermediate the first hydraulic cylinder and the hydraulic actuator, the hydraulic line supplying the sufficient pressure in the fluid to the hydraulic actuator in the remote locale.

24 Claims, 10 Drawing Sheets

SYSTEM FOR CONTROLLING A HYDRAULIC ACTUATOR, AND METHODS OF USING SAME

BACKGROUND OF THE INVENTION

1. Field of the Invention

The present invention is generally directed to the field of hydraulic actuators, and more particularly to a system for controlling a hydraulic actuator, and various methods of using same. In one illustrative example, the present invention is directed to a system for controlling an actuator for a downhole safety valve in a subsea Christmas tree.

2. Description of the Related Art

The production from a subsea well is controlled by a number of valves that are assembled into a Christmas tree. The designs of actuators and valves for subsea wells are dictated by stringent safety and reliability standards, because of the danger of uncontrolled release of hydrocarbons. These valves have traditionally been powered by hydraulic fluid. However, it has recently been proposed to use electrically powered actuators instead, as these offer many advantages. In such subsea systems, all the low-pressure hydraulic actuators are replaced with electrically powered actuators, thus eliminating the entire low-pressure hydraulic system.

Many countries have a requirement for a downhole safety valve (Surface Controlled Subsurface Safety Valve, SCSSV) as an additional safety device for closing the flow path in the well tubing. Since this valve is located remote from the other valves it has its own dedicated actuator. Normally a hydraulic actuator is used, and because the valve is located in the tubing, and thereby in the pressure stream, it must be operated by high-pressure hydraulic fluid. This fluid supply is normally transmitted through a separate line from a special high-pressure supply.

It would be desirable eliminate the high-pressure hydraulic system as well. One possibility that has been contemplated is to omit the SCSSV from the system, thus eliminating the need for high-pressure hydraulic power. However, since SCSSV's are required equipment in many locations they cannot be omitted from all systems. Also, because of the harsh downhole environment, it is accepted as not being reliable to replace the hydraulic SCSSV actuators with less robust electric actuators. Although the high-pressure hydraulic system remains necessary, it would still be desirable to reduce the number and/or complexity of the components that make up the high-pressure system.

To avoid the costs of a dedicated high pressure line from topside several alternatives have been proposed, such as an electrically powered pump, a pressure intensifier, or an accumulator that stores high pressure fluid subsea. These alternatives, however, are complicated, making them generally less reliable and more costly than traditional systems. Also, these alternatives require that more equipment be deployed subsea than in a traditional system.

The present invention is directed to an apparatus for solving, or at least reducing the effects of, some or all of the aforementioned problems.

SUMMARY OF THE INVENTION

The present invention is directed to a system for controlling a hydraulic actuator, and various methods of using same. In one illustrative embodiment, the system comprises a first hydraulic cylinder, an isolated supply of fluid provided to the first hydraulic cylinder, the isolated supply of fluid positioned in an environment that is at a pressure other than atmospheric pressure, an actuator device coupled to the first hydraulic cylinder, the actuator device adapted to drive the first hydraulic cylinder to create a sufficient pressure in the fluid to operate the hydraulic actuator, and at least one hydraulic line operatively intermediate the first hydraulic cylinder and the hydraulic actuator, the hydraulic line supplying the sufficient pressure in the fluid to the hydraulic actuator in the remote locale.

In another illustrative embodiment, the system comprises a first hydraulic cylinder, an isolated subsea source of hydraulic fluid provided to the first hydraulic cylinder, an actuator device coupled to the first hydraulic cylinder, the actuator device adapted to drive the first hydraulic cylinder to pressurize the fluid, and at least one hydraulic line for supplying the pressurized fluid to the hydraulic actuator in the subsea well.

The present invention is also directed to a method of controlling a hydraulic actuator wherein the method comprises providing an isolated supply of fluid, providing fluid from the isolated supply of fluid to a first hydraulic cylinder that is actuated to create a sufficient pressure in the fluid to operate the hydraulic actuator, creating the sufficient pressure with a first hydraulic cylinder, the first hydraulic cylinder being operatively connected to the hydraulic actuator by at least one hydraulic line, and communicating the sufficient pressure to the hydraulic actuator via the at least one hydraulic line.

BRIEF DESCRIPTION OF THE DRAWINGS

The invention may be understood by reference to the following description taken in conjunction with the accompanying drawings, in which like reference numerals identify like elements, and in which.

Figure 1:
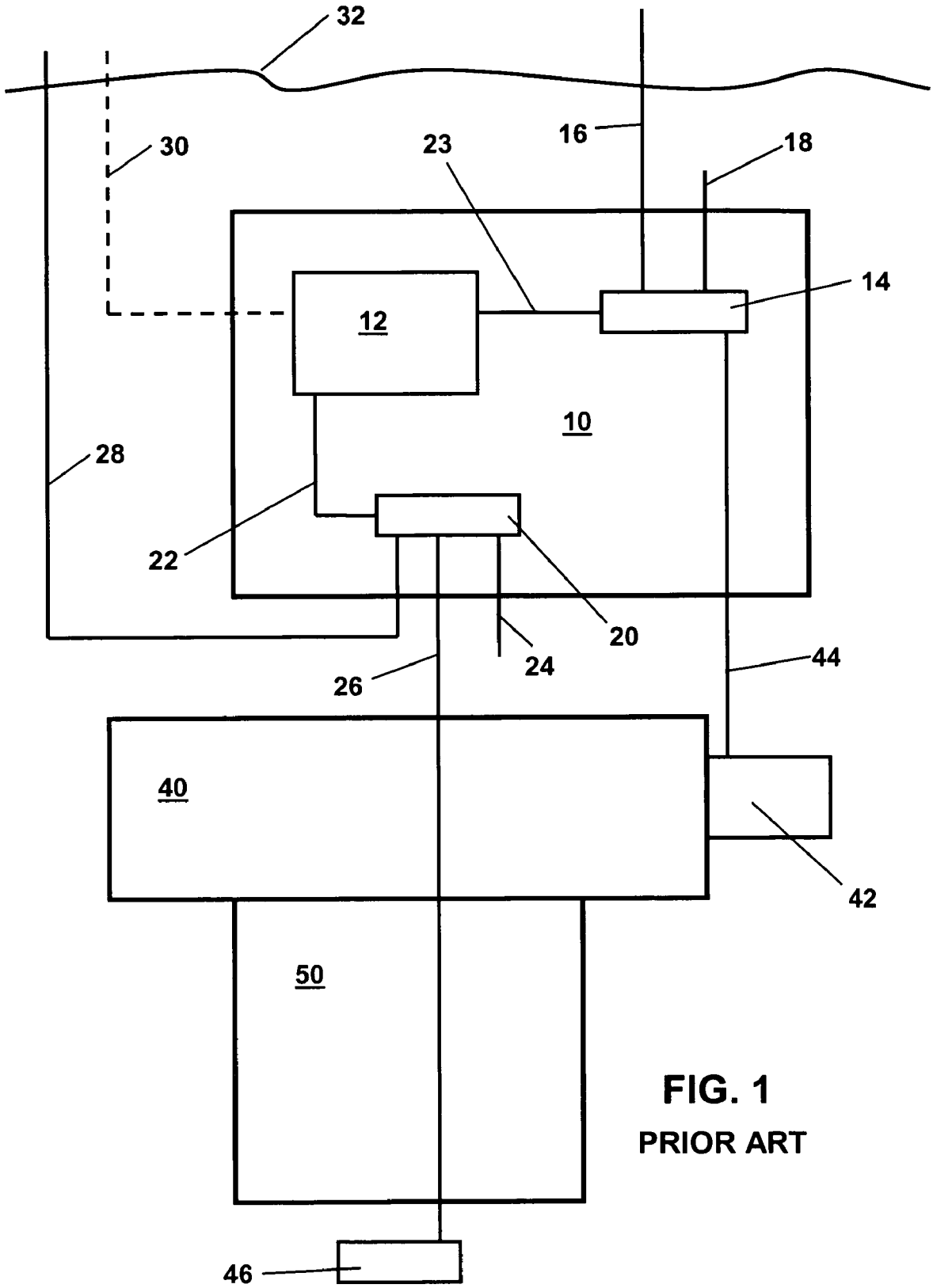
FIG. 1 PRIOR ART
FIG. 1 shows a schematic of a prior art subsea well completion system utilizing high- and low-pressure hydraulic umbilicals to the surface.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present invention will now be described with reference to the attached figures. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

In the specification, terms such as "upward" or "downward" or the like may be used to refer to the direction of fluid flow between various components of the devices depicted in the attached drawings. However, as will be recognized by those skilled in the art after a complete reading of the present application, the device and systems described herein may be positioned in any desired orientation. Thus, the reference to the direction of fluid flow should be understood to represent a relative direction of flow and not an absolute direction of flow. Similarly, the use of terms such as "above," "below," or other like terms to describe a spatial relationship between various components should be understood to describe a relative relationship between the components as the device described herein may be oriented in any desired position.

A typical subsea wellhead control system, shown schematically in FIG. 1, includes a subsea tree 40 and tubing hanger 50. A high pressure hydraulic line 26 runs downhole to a surface-controlled subsea safety valve (SCSSV) actuator 46, which actuates an SCSSV. A subsea control module (SCM) 10 is disposed on or near the tree 40. The SCM includes an electrical controller 12, which communicates with a rig or vessel at the surface 32 via electrical umbilical 30.

Through control line 22, the controller 12 controls a solenoid valve 20, which in turn controls the flow of high-pressure hydraulic fluid from hydraulic umbilical 28 to hydraulic line 26, and thus to SCSSV actuator 46. When controller 12 energizes solenoid valve 20, high-pressure hydraulic fluid from umbilical 28 flows through valve 20 and line 26 to energize SCSSV actuator 46 and open the SCSSV (not shown). The required pressure for the high-pressure system depends on a number of factors, and can range from 5000 to 17,500 psi. In order to operate the SCSSV, the hydraulic fluid pressure must be sufficient to overcome the working pressure of the well, plus the hydrostatic head pressure.

When solenoid valve 20 is de-energized, either intentionally or due to a system failure, a spring in valve 20 returns the valve to a standby position, wherein line 26 no longer communicates with umbilical 28, and is instead vented to the sea through vent line 24. The SCSSV actuator 46 is de-energized, and the SCSSV closes. Typically, solenoid valves such as 20 are relatively large, complex, and expensive devices. Each such valve may include 10 or more extremely small-bore check valves (not shown), which are easily damaged or clogged with debris.

Through control line 23, the controller 12 controls a number of solenoid valves such as 14, which in turn control the flow of low-pressure hydraulic fluid from hydraulic umbilical 16 to hydraulic line 44, and thus to actuator 42. Hydraulic fluid, which is vented from actuators such as 42, is returned to solenoid valve 14 and vented to the sea through vent line 18. Typically the low-pressure system will operate at around 3000 psi. Actuator 42 may control any of a number of hydraulic functions on the tree or well, including operation of the production flow valves (not shown). A typical SCM may include 10–20 low-pressure solenoid valves such as 14.

Figure 2:
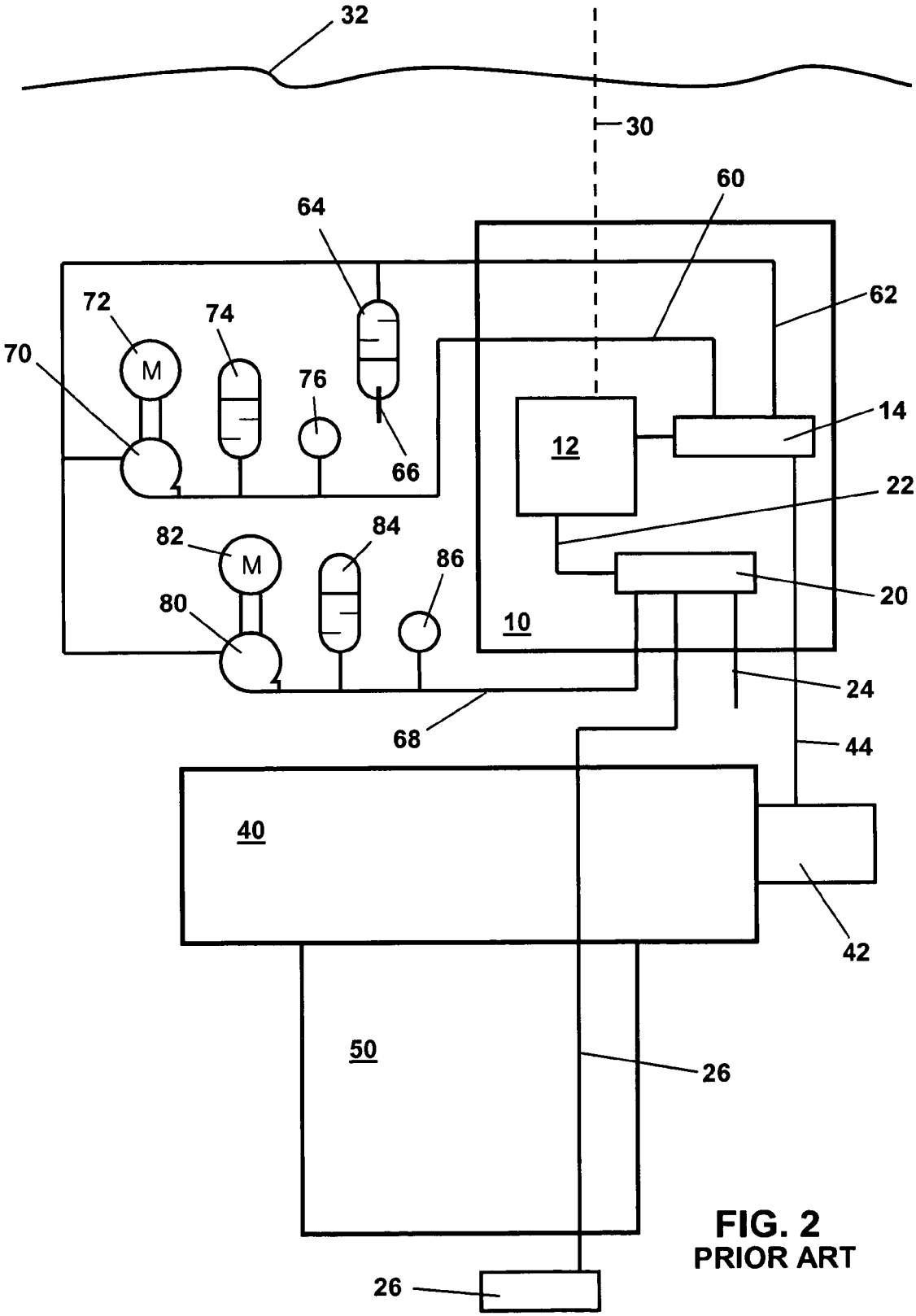
FIG. 2 PRIOR ART
FIG. 2 shows a schematic of a prior art subsea well completion system utilizing a subsea HPU for high- and low-pressure hydraulic power.

For numerous reasons it is desirable to eliminate the need for hydraulic umbilicals extending from the surface to the well. Referring to FIG. 2, one known method for accomplishing this is to provide a source of pressurized hydraulic fluid locally at the well. Such a system includes a SCM 10 essentially similar to that shown in FIG. 1. However, in the system of FIG. 2, supplies of each high- and low-pressure hydraulic fluid are provided by independent subsea-deployed pumping systems.

A storage reservoir 64 is provided at or near the tree, and is maintained at ambient hydrostatic pressure via vent 66. Low-pressure hydraulic fluid is provided to solenoid valves 14 through line 60 from a low-pressure accumulator 74, which is charged by pump 70 using fluid from storage reservoir 64. Pump 70 is driven by electric motor 72, which may be controlled and powered from the surface, or locally by a local controller and battery power source (either of which is not shown). The pressure in line 60 may be monitored by a pressure transducer 76 and fed back to the motor controller (not shown). Hydraulic fluid, which is vented from actuators such as 42, is returned to storage reservoir 64 via return line 62. High-pressure hydraulic fluid is provided to solenoid valve 20 through hydraulic line 68 from a high-pressure accumulator 84, which is charged by pump 80 using fluid from storage reservoir 64. Pump 80 is driven by electric motor 82, which may be controlled and powered from the surface or locally by a local controller and battery power source (either of which is not shown). The pressure in hydraulic line 68 may be monitored by a pressure transducer 86 and the pressure information fed back to the motor controller (not shown).

In one embodiment, the present invention is directed to a local subsea source of high-pressure hydraulic fluid that is small, reliable and will provide the necessary hydraulic power to operate an SCSSV or other hydraulically actuable valve in a safe manner. According to one embodiment of the present invention, this is achieved by using a simple pressurising piston that can be actuated by an electric motor. When actuated, the piston will pressurize hydraulic fluid, which is used to drive a downhole slave cylinder, which, in turn, actuates the valve. In an alternative embodiment, the pressure in a flowline is used to pressurize the hydraulic fluid. This arrangement has the added benefit that when pressure in the flowline drops the SCSSV will automatically close.

Figure 3A:
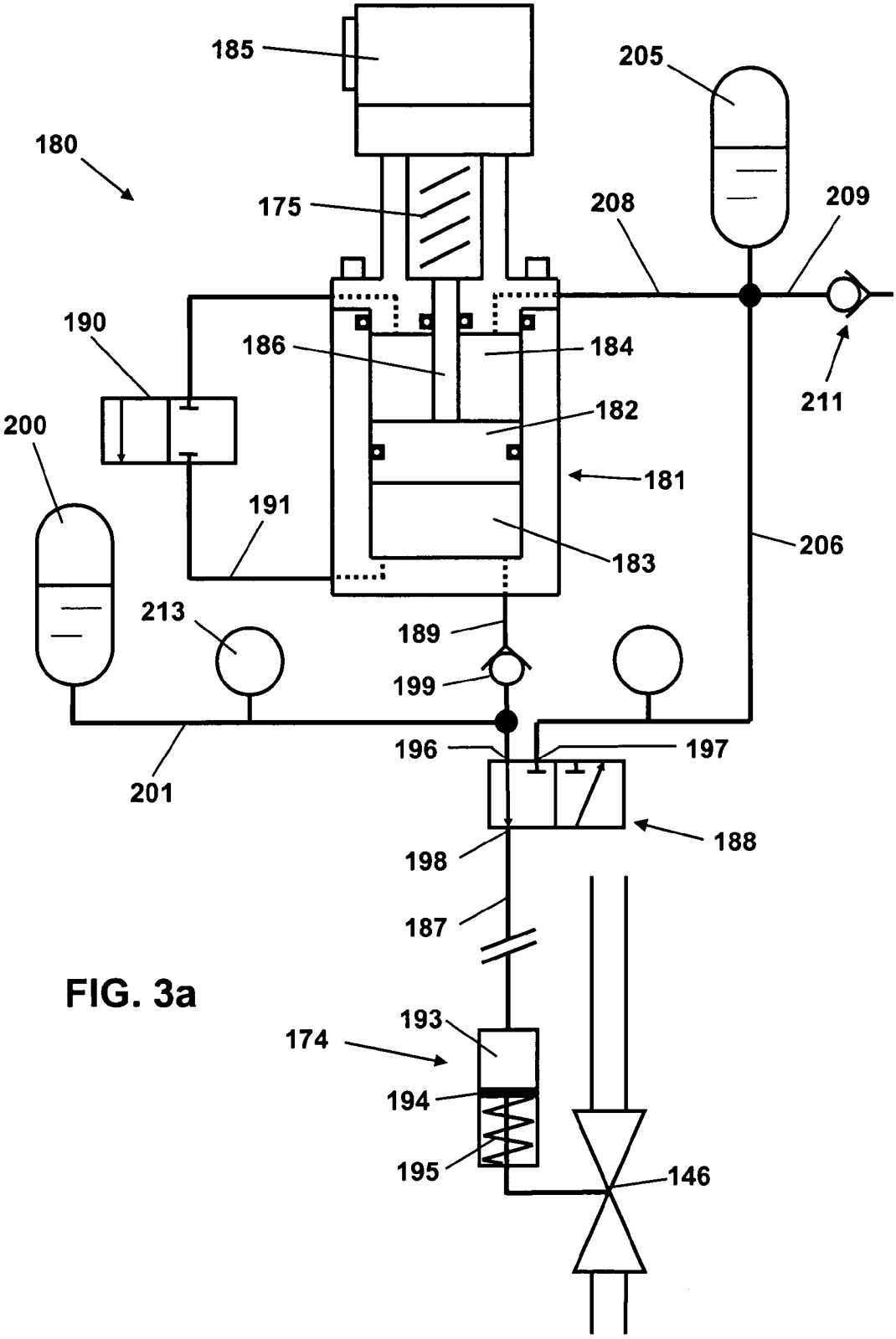
FIGS. 3*a* through 3*c* show a schematic of an exemplary embodiment of the present invention in various operating configurations.
Figure 3B:
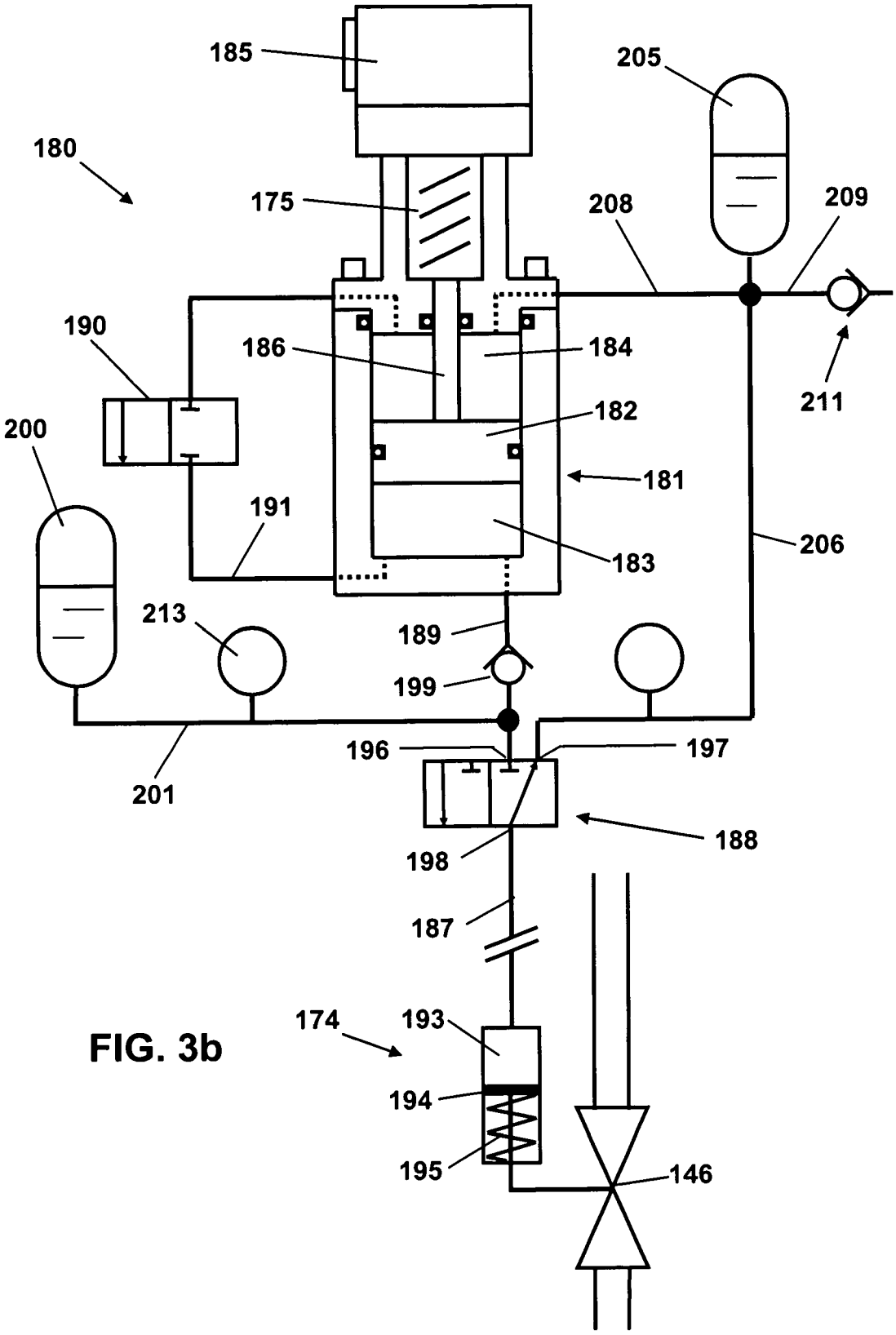
Figure 3C:
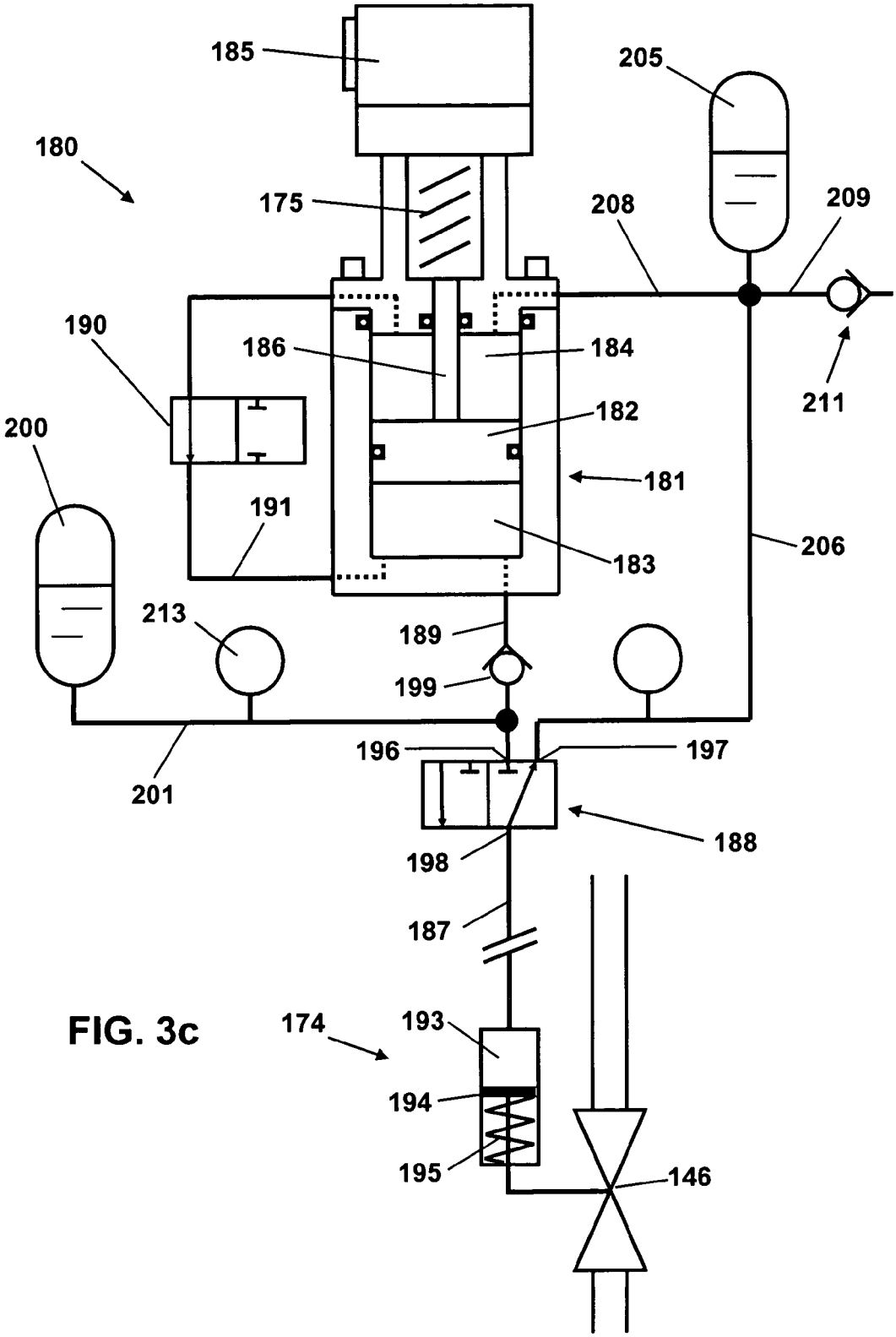

In an exemplary embodiment, a system for providing high-pressure fluid for controlling an SCSSV is shown schematically in FIGS. 3*a* through 3*c*. A subsea hydraulic power unit (HPU) is housed or otherwise contained in a unit 180 that is located near the Christmas tree. In this illustrative embodiment, the source of hydraulic fluid (gas or liquid) is an isolated source of hydraulic fluid that is positioned in an environment, e.g., subsea, that is at a pressure other than atmospheric pressure. The unit may either or both be packaged as a portable unit and releasably connected to a frame so that it can be easily retrieved for repair. The unit 180 includes a master cylinder 181 with a piston 182 reciprocally movable axially in the cylinder, thus dividing the cylinder into two chambers 183 and 184. The two chambers 183 and 184 are interconnected through a bypass line 191, the flow through the bypass being controlled by a bypass control valve 190.

In the exemplary embodiment the actuator that moves piston 182 may be of the same type as used in the device of FIG. 2, described above, consisting of an electric motor with a gearbox and transmission. In the exemplary embodiment, an electric motor 185 is operatively connected to a shaft 186 by a suitable gearbox 175, such that operation of motor 185 may precisely control the motion of piston 182. Examples of a suitable motor 185 and gearbox 175 combination include a Model Number TPM 050 sold by the German company Wittenstein. The motor may alternatively be a linear electric motor.

In the well tubing there is mounted a controllable downhole safety valve 146, known in the art as an SCSSV (Surface Controlled Subsurface Safety Valve). As is well known in the art, the SCSSV includes a hydraulic cylinder including a "slave" chamber 193. To actuate the SCSSV, chamber 193 is pressurized, pushing a piston 194 against the biasing force of a spring 195 to open the valve 146. A fluid line 187 is connected between the slave chamber 193 with an outlet port 198 of an operation control valve 188. A first inlet port 196 of operation control valve 188 is connected to fluid line 189, which is connected to cylinder chamber 183. This arrangement controls the flow of fluid from master cylinder 181 to the SCSSV actuator 174. A check valve 199 is mounted in line 189, between the operation control valve 188 and the chamber 183. The check valve 199 allows fluid to flow from chamber 183 to chamber 193, but not the reverse.

An accumulator 200, containing a supply of hydraulic fluid, is connected to the fluid line 187 via line 201, at a point between operation control valve 188 and check valve 199. The accumulator 200 provides a buffer for the high pressure hydraulic fluid, and ensures that the SCSSV will stay open under normal operating conditions.

A pressure balanced compensator 205 is connected to a second inlet port 197 of operation control valve 188 via line 206. A fluid line 208 connects compensator 205 with chamber 184 of master cylinder 181. A fluid line 209 connects compensator 205 with a hydraulic coupling 211. The coupling 211 allows hydraulic fluid to be supplied from an external source (not shown) so that fluid can be added to the hydraulic system.

Referring to FIG. 3*a*, when the motor 185 is energized the piston 182 will move downward in the master cylinder 181. This forces high-pressure fluid through the line 187 to the slave cylinder 193 in the downhole valve actuator 174, with the operation control valve 188 is in a first or open position. On the downstroke, the chamber 184 of master cylinder 181 is refilled from compensator 205. Check valve 199 and accumulator 200 cooperate to maintain the pressure in the line 187 at a level that will hold the SCSSV valve open. Referring to FIG. 3*b*, to close the SCSSV valve, the operation control valve 188 is shifted to its second or closed position. In the second position, operation control valve 188 allows fluid to flow back up through line 187, through line 206 and back into compensator 205. In other words, the slave chamber 193 of the downhole actuator is vented through operation control valve 188 to the low-pressure system.

The pressure differential across piston 182 will normally force the piston back to its upper starting position when the motor is de-energized. However, under certain conditions it may be necessary to reset the piston 182 to the upper position. To do this, bypass control valve 190 is shifted to a second, or open position, as shown in FIG. 3*c*. In the second position, bypass control valve 190 allows fluid to flow through the bypass line between the two chambers 183 and 184 of the master cylinder. The electric motor 185 may then be run in reverse in order to move the piston 12 back to the upper starting position.

Referring to FIG. 3*b*, when it is desired to recharge the accumulator 200, the operation control valve 188 is shifted to its second position and the motor 185 is energized to drive the piston 182 downward in master cylinder 181. A pressure sensor 213 in line 201 monitors the pressure in the accumulator 200, making it possible to stop the motor 185 when desired pressure is reached.

From time to time it may become necessary to replenish the hydraulic fluid in the system, to replace fluid lost due to leaks, for example. To accomplish this, an external source (not shown) of hydraulic fluid may be coupled to the hydraulic coupler 211. Fluid from the external source fills the compensator 205 and first chamber 184 of master cylinder 181. By shifting the bypass control valve 190 to its open position (FIG. 3*c*), fluid may also flow into second chamber 183. Bypass control valve 190 may then be moved to the closed position (FIG. 3*b*), and piston 182 may be moved downwards to recharge the accumulator 200, as previously described.

The exemplary embodiment of the invention shown in FIGS. 3*a* through 3*c* includes a high-pressure section, including accumulator 200, which is maintained at a pressure which is sufficient to operate the SCSSV. This embodiment also includes a low-pressure section, including compensator 205, which is maintained at a second pressure which is less than the pressure required to operate the SCSSV. The compensator 205 may be partly filled with an inert gas such as nitrogen, which compensates for pressure differences due to operation of the SCSSV, and which also primes the system for use at various water depths.

By utilizing the exemplary embodiment of the invention shown in FIGS. 3*a* through 3*c*, a standard, hydraulically actuated downhole safety-valve can be used while eliminating the need for a high-pressure hydraulic fluid supply from the surface. Standard downhole safety valves have a spring failsafe feature so that the valve will close when pressure is relieved in the system: The valve will therefore also close in the event of a hydraulic system failure. In an emergency the SCSSV can quickly be closed by shifting operation control valve 188 to its second position, thus venting the high-pressure fluid from line 187.

Figure 4:
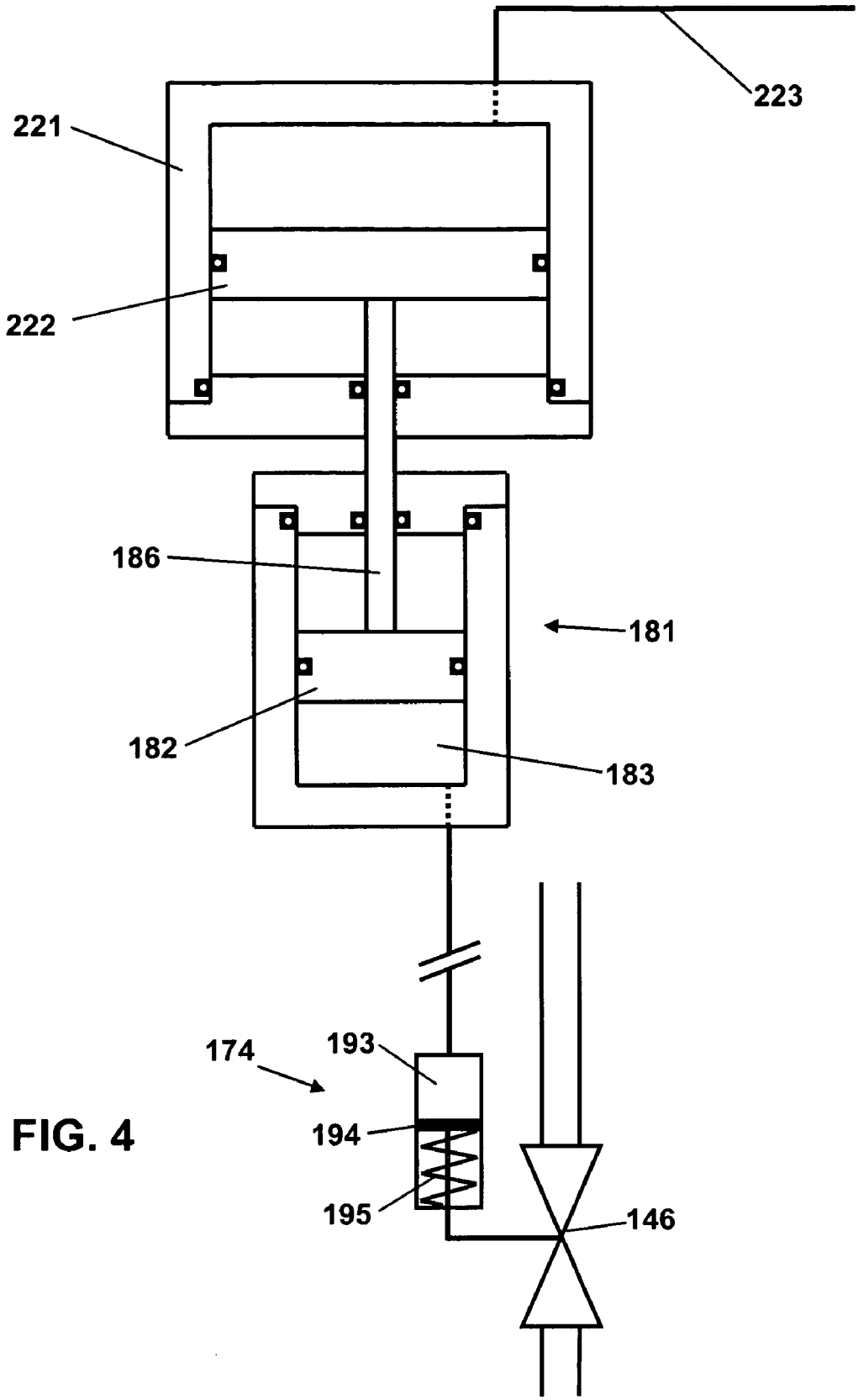
FIG. 4 shows a schematic of an alternative exemplary embodiment of the present invention.

An alternative exemplary embodiment of the invention is shown in FIG. 4. In this embodiment, the piston shaft 186 of master cylinder 181 is connected a second piston 222 housed in a low-pressure cylinder 221. This embodiment may be used with water injection wells, in which case the low-pressure cylinder 221 is connected to the water injection flowline via line 223. The area of the second piston 222 is selected such that the force of the injection water acting on piston 222 is sufficient to pressurize the fluid in chamber 183 to a level sufficient to actuate the safety valve 146. As long as injection water is pumped through the flowline, it will maintain the pressure on piston 222, and thus maintain the SCSSV in the open position. If the water pressure in the injection flowline 223 drops below a certain threshold, for example, by stopping the injection pumps (not shown), the piston 222 will move back in the cylinder 221, thus relieving the high-pressure in the downhole actuator 174, and allowing the SCSSV 146 to move to the closed position.

Figure 5A:
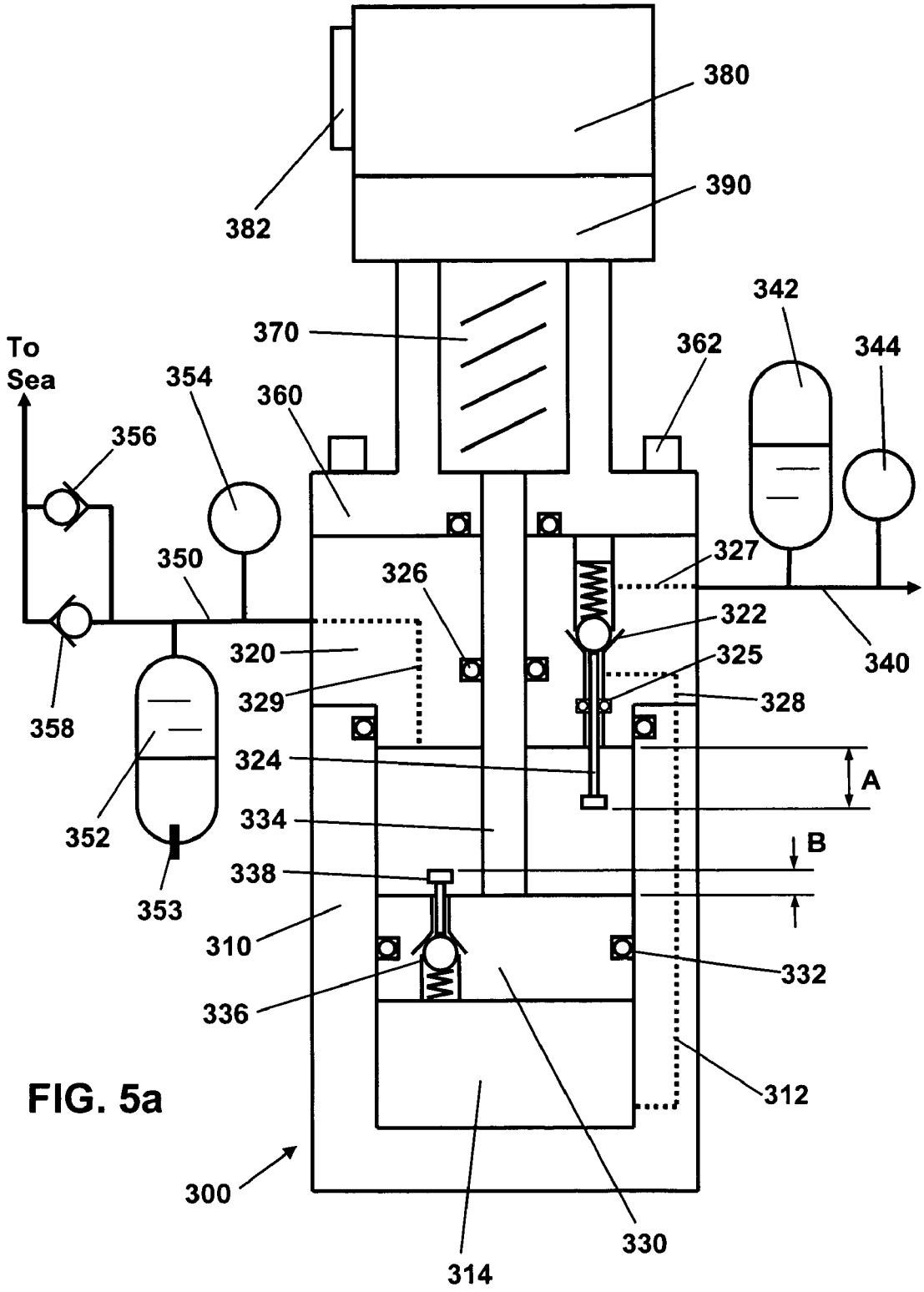
FIGS. 5*a* through 5*c* show an alternate exemplary embodiment of a suitable hydraulic power unit for use in the inventive system.
Figure 5B:
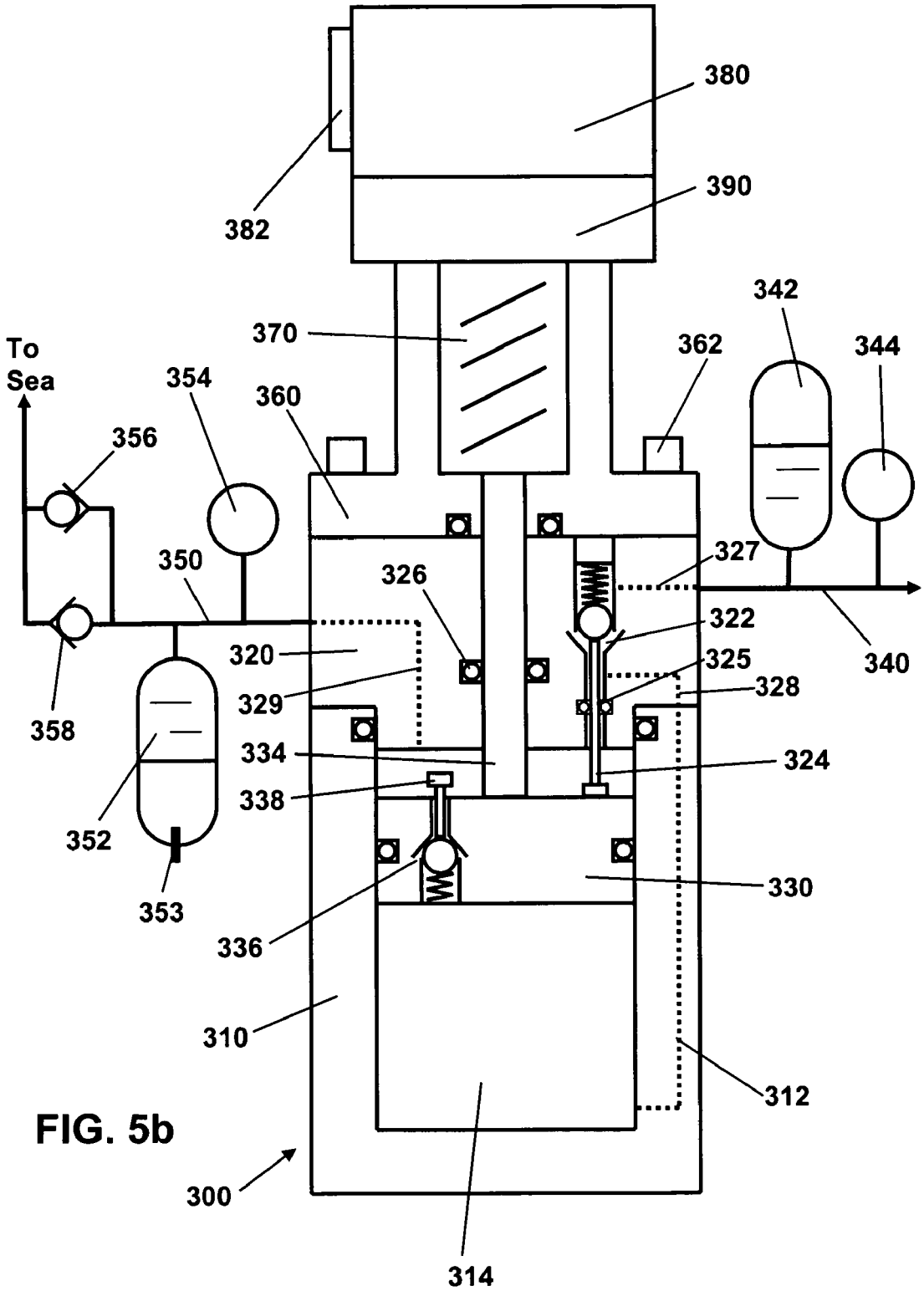
Figure 5C:
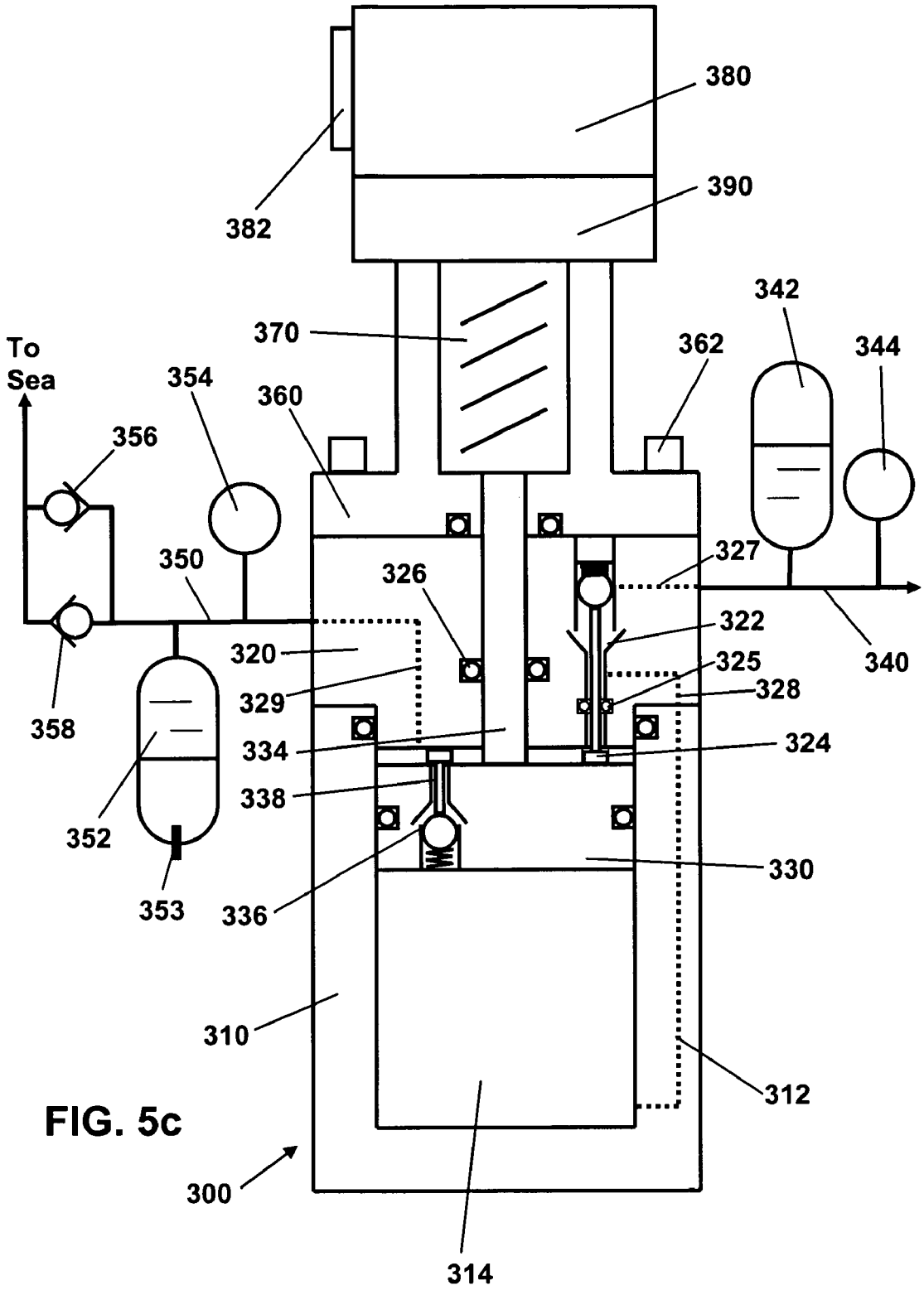

Referring to FIGS. 5*a* through 5*c*, in one embodiment, the HPU 300 comprises a housing 310 and cap 320, which cooperate to define a piston chamber 314. Piston 330 is disposed within chamber 314, and is slidably sealed thereto via seal assembly 332. Stem 334 is attached to piston 330, and extends through an opening in cap 320. Stem packing 326 seals between cap 320 and stem 334. In other embodiments, housing 310 and cap 320 could be formed as one integral component, with an opening at the bottom of the housing, which could be sealed by a blind endcap member.

Electric motor 380 may be mounted to cap 320 via mounting flange 360 and bolts 362, or by any other suitable mounting means. The motor 380 may be connected to a motor controller and a power source via connector 382. The motor controller may be deployed subsea and may communicate with a surface rig or vessel via an electrical umbilical or by acoustic signals. Alternatively the motor could be controlled directly from the surface. The motor may be powered by a subsea deployed power source, such as batteries, or the motor could be powered directly from the surface.

In this exemplary embodiment, the motor 380 is connected to stem 334 via planetary gearbox 390 and roller screw assembly 370. Thus, when motor 380 is energized, the rotational motion of the motor is converted into axial motion of the stem 334, thereby also moving piston 330 axially within piston chamber 314. Alternatively, either the gearbox 390 or roller screw assembly 370, or both, could be omitted or replaced by any other suitable transmission devices. Also alternatively, the motor 380 could comprise a linear motor.

Piston 330 is provided with a one-way check valve 336, which normally allows fluid to flow through the piston in a first direction, i.e., from top to bottom only, as viewed in FIG. 5. Piston 330 is also provided with a plunger 338 extending upwardly therefrom, which is arranged to open the check valve 336 to two-way flow when the plunger is depressed. The plunger 338 extends a known distance B above the top of the piston 330, such that when the top of piston 330 is less than distance B from the bottom of cap 320, plunger 338 is depressed and check valve 336 is opened. In alternative embodiments, any suitable flow control device could be used which (a) allows only flow in the first direction, e.g., downward flow, through the piston 330 when the piston is more than a distance B from the cap, and (b) allows flow in a second direction, e.g., upward flow, when the piston is less than a distance B from the cap.

Cap 320 includes a flow passage 329, which provides fluid communication between hydraulic line 350 and the portion of chamber 314 above the piston. Hydraulic reservoir 352, which is preferably provided on or near the tree, supplies fluid to line 350 and is maintained at ambient hydrostatic pressure via vent 353. Hydraulic line 350 is connected to the sea via oppositely oriented check valves 356 and 358. The pressure in line 350 may be monitored by pressure transducer 354, and the pressure information communicated to the surface and/or fed back to the motor controller.

Under certain circumstances, hydraulic reservoir 352 could become overcharged with fluid, such that the pressure in the reservoir 352 and line 350 becomes too high, and cannot be equalized with the ambient hydrostatic pressure through vent 353. In this case, excess fluid in line 350 would be discharged to the sea through check valve 356, thus maintaining the desired ambient pressure in line 350. Under other circumstances, such as a hydraulic leak, hydraulic reservoir 352 could become depleted of fluid, such that the pressure in the reservoir 352 and line 350 falls below the desired ambient hydrostatic pressure. In this case, seawater may be drawn into line 350 through check valve 358, in order to maintain the desired ambient pressure in line 350. In alternative embodiments, SCSSV actuator 48 and/or downhole hydraulic line 26 could be pre-filled with a fluid which is denser than either the hydraulic fluid used in the rest of the system, or seawater. Thus, if seawater is drawn into the system due to a leak, the heavier fluid will only be replaced by seawater down to the point of the leak. All components below the leak will be exposed only to the heavier pre-loaded fluid.

Cap 320 is provided with a one-way check valve 322, which normally allows flow from bottom to top only, as viewed in FIG. 5. Cap 320 is also provided with a plunger 324 extending downwardly therefrom, which is arranged to open the check valve 322 to two-way flow when the plunger is depressed. The plunger 324 extends a known distance A below the bottom of the cap 320, such that when the top of piston 330 is less than distance A from the bottom of cap 320, plunger 324 is depressed and check valve 322 is opened. Note that distance A is greater than distance B. In alternative embodiments, any suitable flow control device could be used which (a) allows flow in only one direction through the cap 320 when the piston 330 is more than a distance A from the cap, and (b) allows flow in the other direction through the cap when the piston is less than a distance A from the cap.

Flow passage 328 in the cap extends from below the check valve 322 and communicates with passage 312 in the housing 310. Passage 312 communicates with the portion of chamber 314 below the piston 330. Flow passage 327 in the cap extends from above the check valve 322 to hydraulic line 340, which in turn extends to the SCSSV actuator (not shown). As discussed above, in other embodiments the housing 310 and cap 320 could be formed as one integral component. In such an embodiment, all of the features described above with respect to the housing 310 and cap 320 would be incorporated into the combined integral component.

High-pressure hydraulic accumulator 342 is provided on or near the tree, and communicates with line 340. The pressure in line 340 may be monitored by pressure transducer 344, and the pressure information communicated to the surface and/or fed back to the motor controller. In other embodiments, the high-pressure hydraulic accumulator 342 may be omitted.

In one illustrative example, the operation of the HPU 300 is as follows:

Pumping to the Desired Pressure

The present invention may be employed to provide a pressurized fluid to a hydraulically actuable device. In one illustrative embodiment, the device disclosed herein may be employed in connection with subsea wells having a hydraulically actuable SCSSV valve. For purposes of disclosure only, the present invention will now be described with respect to its use to actuate and control the operation of a subsea SCSSV valve. However, after a complete reading of the present application, those skilled in the art will appreciate that the present invention is not so limited and has broad applicability. Thus, the present invention should not be considered as limited to use with subsea wells or controlling SCSSV valves.

When it is desired to open the SCSSV, such as for producing the well, the SCSSV supply line 340 and high-pressure accumulator 342 are charged to the desired pressure by stroking piston 330. Assuming that piston 330 is near the top of chamber 314, the piston is stroked downward. Check valve 336 prevents hydraulic fluid from flowing upwardly through piston 330. Therefore, hydraulic fluid is forced from chamber 314 through passages 312 and 328, through check valve 322, through passage 327 and into line 340 and accumulator 342. Piston 330 is then stroked upwards. However, piston 330 is not moved all the way to the top of chamber 314. Rather, through precise control of the motor 380, the piston 330 is stopped on the upstroke before contacting plunger 324. Thus, check valve 322 remains closed, and pressure is maintained in accumulator 342 and line 340. As piston 330 rises, a pressure differential develops across the piston, which forces check valve 336 to open. This allows the portion of chamber 314 below the piston to be refilled with fluid from reservoir 352. The piston 330 is then downstroked again, and this process is repeated until the desired pressure is achieved in accumulator 342 and line 340. This can be considered the pumping mode of operation of the HPU 300.

By precisely controlling the torque and position of motor the 380, the position of piston 330 may also be precisely controlled to maintain the desired working pressure in line 340. The SCSSV is now maintained in the open position by the pressure in line 340. Because the desired working pressure can be achieved by repeated stroking of the piston 330, the minimum volume of the piston chamber 314 is independent of the total amount of fluid which actually needs to be pumped. Thus, the total required pumping volume does not constrain the minimum size of the housing 310 and piston 330. Furthermore, in one illustrative embodiment, the HPU 300 does not include any failsafe return spring(s), which are typically quite large and heavy. This allows for further reduction in the size of the unit.

Arming the HPU for Failsafe Shutdown

Once the desired working pressure has been achieved, the HPU 300 is placed in the "armed", or stand-by position. The piston 330 is upstroked until the distance between the piston 330 and the cap 320 is less than distance A, but greater than distance B. In this position, piston 330 contacts and depresses plunger 324, thus opening check valve 322 to two-way flow. However, plunger 338 is not depressed, and thus check valve 336 remains closed to upward flow. Since check valve 322 is opened, the pressure in line 340, i.e., the working pressure, is communicated through check valve 322, passages 328 and 312, and into the portion of chamber 314 below the piston 330. Thus, the pressure from line 340 acts exerts an upward pressure force on the piston 330. In one embodiment, the present invention comprises means for resisting this pressure force. In one example, the means for resisting the pressure force comprises at least the motor 380.

Figure 6:
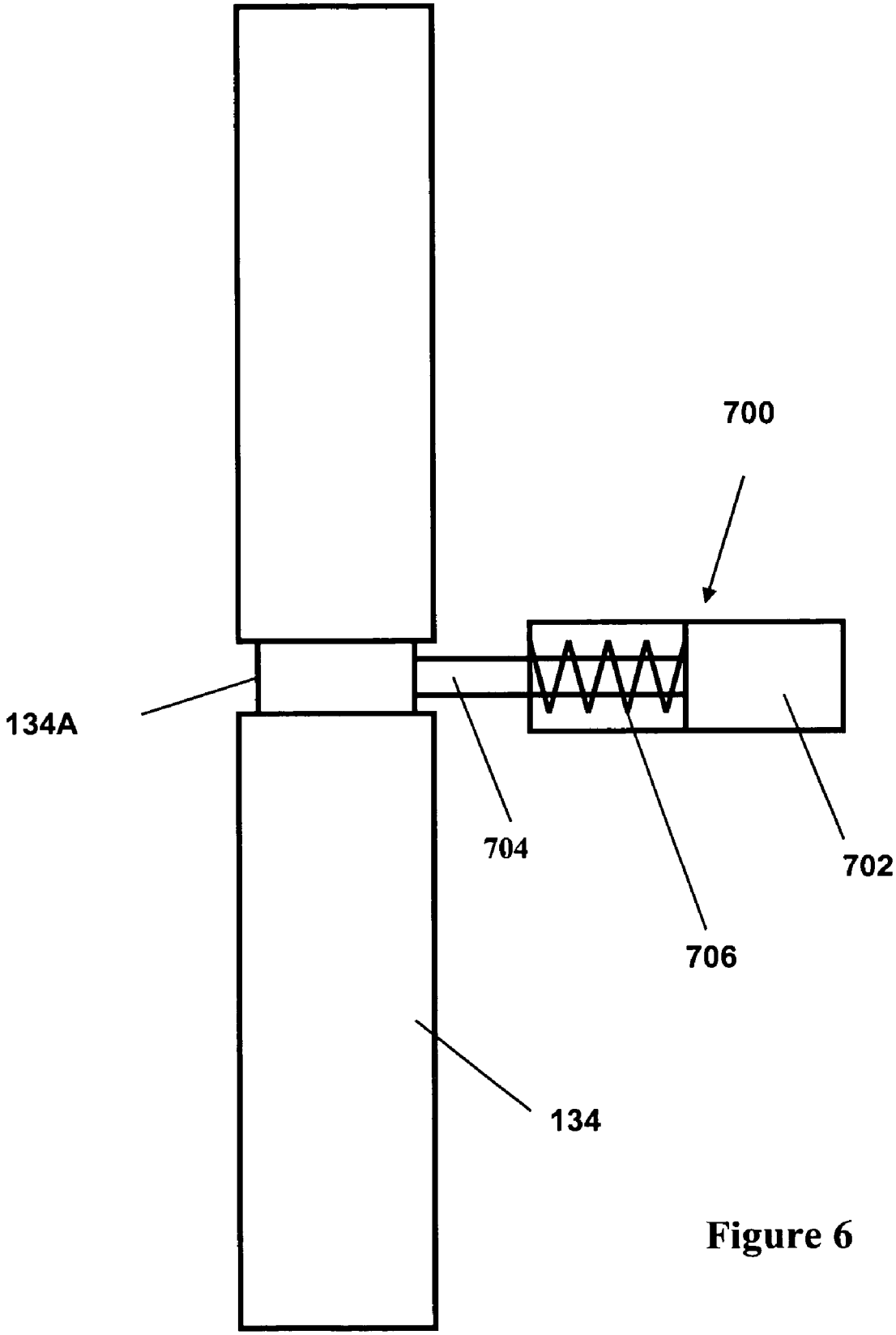
FIG. 6 depicts one illustrative embodiment of a latching mechanism that may be employed with the present invention.

Alternatively, the means for resisting the pressure force may comprise an electric latching mechanism that may be employed to hold the stem and piston in position, thus removing the load from the motor 180. FIG. 6 schematically depicts an illustrative latching mechanism 700 that may be employed with the present invention. As shown therein, the latching mechanism 700 comprises an electrically powered solenoid 702, a pin 704 and a return biasing spring 706. When the latching mechanism is energized, the pin 704 engages a recess or groove 134A formed on the shaft 134. In this embodiment, the latching mechanism 700 would be arranged to release the stem and piston 130 upon a loss of electrical power. This can be considered the armed mode of operation of the HPU 100.

Bleed-off and Shutdown

When the motor 380 and/or the latching mechanism are de-energized, either intentionally or due to an electrical system failure, the motor and/or latching mechanism will no longer maintain the piston 330 in the armed position. The motor 380, gearbox 390, and roller screw 370, in one embodiment, are selected and arranged such that the pressure acting on the piston 330 is sufficient to backdrive the motor and transmission assembly and raise the piston to the top of chamber 314. As the piston 330 approaches the top of chamber 314, the cap 320 contacts and depresses plunger 338, thus opening check valve 336 to two-way flow. Thus, the pressure in chamber 314, accumulator 342, and line 340 is exhausted to the ambient pressure reservoir 352 through check valve 336 and passage 329. The SCSSV actuator is now de-energized, and the SCSSV is closed. This may be considered the shut-down mode of operation of the HPU 300.

No additional control signal is required to select the operational mode of the HPU. The failsafe mode of the HPU 300 is powered by stored hydraulic pressure, so there is no need for a failsafe return spring in piston chamber 314. This results in substantial savings in the weight, size and cost of the unit.

Referring to FIG. 3, as discussed above, the current invention permits resupply of the isolated supply of fluid that the system uses to hold and transmit hydraulic pressure from a variety of transfer systems. The external source of fluid may be a hose from the surface. Alternatively, a remotely operated vehicle (ROV) may be flown to the well with a supply of fluid and coupled to hydraulic coupler 211. Alternatively, the system may also use seawater as the hydraulic fluid, since the current HPU's 180 and 300 (in FIG. 5) eliminate the prior art solenoid valve 20 (in FIGS. 1 and 2) that was prone to plugging from contaminants.

In a case where seawater may be used as the hydraulic fluid, it is advisable to use a highly suited hydraulic fluid possessing a high specific gravity to initially fill the lowest sections of the system. The heavy fluid in fluid line 187 would tend to settle into the lowest parts of the system, in contact with the downhole valve actuator 174. In this way downhole valve actuator 174 would not come in contact with the seawater. Downhole valve actuator 174 would therefore not be adversely affected by seawater filling the balance of the system. A heavy fluid is used so that an unanticipated leak in any part of the system above line 187 would result in the heavy fluid still remaining in position as a protective barrier for the vital downhole valve actuator 174, from impurities that may be in any other fluids gaining access to the system. Even a leak in line 187, as long as it were to be slightly above the downhole valve actuator 174 would still result in the downhole valve actuator 174 being protected. In this manner operation with an operational SCSSV 146 may be continued until repair equipment can be put on site, extremely shortening the resulting downtime.

The present invention is directed to a system for controlling a hydraulic actuator, and various methods of using same. In one illustrative embodiment, the system comprises a first hydraulic cylinder, an isolated supply of fluid provided to the first hydraulic cylinder, the isolated supply of fluid positioned in an environment that is at a pressure other than atmospheric pressure, an actuator device coupled to the first hydraulic cylinder, the actuator device adapted to drive the first hydraulic cylinder to create a sufficient pressure in the fluid to operate the hydraulic actuator, and at least one hydraulic line operatively intermediate the first hydraulic cylinder and the hydraulic actuator, the hydraulic line supplying the sufficient pressure in the fluid to the hydraulic actuator in the remote locale.

In another illustrative embodiment, the system comprises a first hydraulic cylinder, an isolated subsea source of hydraulic fluid provided to the first hydraulic cylinder, an actuator device coupled to the first hydraulic cylinder, the actuator device adapted to drive the first hydraulic cylinder to pressurize the fluid, and at least one hydraulic line for supplying the pressurized fluid to the hydraulic actuator in the subsea well.

The present invention is also directed to a method of controlling a hydraulic actuator wherein the method comprises providing an isolated supply of fluid, providing fluid from the isolated supply of fluid to a first hydraulic cylinder that is actuated to create a sufficient pressure in the fluid to operate the hydraulic actuator, creating the sufficient pressure with a first hydraulic cylinder, the first hydraulic cylinder being operatively connected to the hydraulic actuator by at least one hydraulic line, and communicating the sufficient pressure to the hydraulic actuator via the at least one hydraulic line.

The particular embodiments disclosed above are illustrative only, as the invention may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A system for controlling a hydraulic actuator in a subsea locale, said hydraulic actuator adapted to operate when provided with a sufficient pressure to open a downhole safety valve, said system comprising:

a first hydraulic cylinder;

an isolated supply of fluid provided to said first hydraulic cylinder, said isolated supply of fluid positioned in an environment that is at a pressure other than atmospheric pressure;

an actuator device coupled to said first hydraulic cylinder, said actuator device positioned in said environment, said actuator device adapted to drive said first hydraulic cylinder to create said sufficient pressure in said fluid; and at least one hydraulic line operatively intermediate said first hydraulic cylinder and said hydraulic actuator, said at least one hydraulic line supplying said sufficient pressure in said fluid to said hydraulic actuator in said subsea locale to thereby open said downhole safety valve.

2. The system of claim 1, wherein said actuator device is an electric motor and gear assembly.

3. The system of claim 1, further comprising:

a hydraulic fluid supply reservoir for storing a quantity of said supply of fluid, said fluid in said hydraulic fluid supply reservoir at a pressure that is less than said sufficient pressure; and an operation control valve in said at least one hydraulic line selectively positionable to put said hydraulic actuator in fluid communication with either of said first hydraulic cylinder and said hydraulic fluid supply reservoir.

4. The system of claim 1, further comprising:

a bypass control valve operatively connected to said first hydraulic cylinder to permit said actuator device to drive said first hydraulic cylinder without substantially increasing a pressure of said fluid.

5. The system of claim 1:

wherein said first hydraulic cylinder comprises a movable pressure barrier, a first chamber and a second chamber, and wherein said first chamber is adapted to be in fluid communication with said supply of fluid, said second chamber is adapted to be selectably in fluid communication with said hydraulic actuator; and a bypass control valve selectively providing fluid communication between said first chamber and said second chamber.

6. The system of claim 1, further comprising:

a resupply line and a resupply coupling, said resupply coupling adapted to interface with an external source of fluid; and said resupply line being positioned intermediate said resupply coupling and said hydraulic supply reservoir.

7. The system of claim 1, wherein said hydraulic fluid is comprised of seawater.

8. A system for controlling a hydraulic actuator in a subsea well, comprising:

a first hydraulic cylinder;

an isolated subsea source of hydraulic fluid provided to said first hydraulic cylinder;

an actuator device positioned subsea and coupled to said first hydraulic cylinder, said actuator device adapted to drive said first hydraulic cylinder to pressurize said fluid; and at least one hydraulic line for supplying said pressurized fluid to said hydraulic actuator in said subsea well, wherein said hydraulic actuator is adapted to open a downhole safety valve when said pressurized fluid is supplied to said hydraulic actuator.

9. The system of claim 8, wherein said hydraulic actuator in said subsea well comprises a single-acting hydraulic cylinder having an actuator piston and a return spring, said actuator piston being movable between a first position in which said downhole safety valve is open, and a second position in which said downhole safety valve is closed, said actuator piston being movable to said first position when said pressurized fluid is supplied to said single-acting hydraulic cylinder, and said actuator piston being movable to said second position by said return spring when said single-acting hydraulic cylinder is vented to thereby allow a pressure of said pressurized fluid to be reduced.

10. The system of claim 8, wherein said actuator device comprises an electric motor.

11. The system of claim 8, further comprising a first control valve disposed between said hydraulic cylinder and said hydraulic actuator in said subsea well, said first control valve having at least a first position which allows said pressurized fluid to be supplied to said hydraulic actuator in said subsea well and a second position which vents said pressurized fluid in said hydraulic actuator in said subsea well to thereby reduce a pressure of said pressurized fluid.

12. A method of controlling a subsea hydraulic actuator, said hydraulic actuator adapted to operate when provided with a sufficient pressure to open a subsea safety valve, said method comprising:

providing an isolated subsea supply of fluid;

providing fluid from said isolated subsea supply of fluid to a first hydraulic cylinder that is actuated to create said sufficient pressure in said fluid, said first hydraulic cylinder being positioned subsea and being operatively connected to said hydraulic actuator by at least one hydraulic line;

communicating said sufficient pressure to said hydraulic actuator via said at least one hydraulic line to thereby open said subsea safety valve;

actuating an operation control valve positioned in said hydraulic line to place said hydraulic actuator in fluid communication with said first hydraulic cylinder or a hydraulic fluid supply reservoir, said reservoir adapted to store fluid at a pressure that is less than said sufficient pressure; and resupplying fluid to said isolated supply of hydraulic fluid through a resupply line and a resupply coupling, said resupply coupling adapted to interface with an external source of hydraulic fluid, and said resupply line operatively intermediate said resupply coupling and said hydraulic supply reservoir.

13. The method of claim 12, further comprising:

filling said first hydraulic cylinder with a portion of said supply of hydraulic fluid by opening a bypass control valve selectively providing fluid communication between a first chamber and a second chamber of said first hydraulic cylinder, said first chamber in fluid communication with said supply of hydraulic fluid, and said second chamber in fluid communication with said hydraulic actuator.

14. A system for controlling a hydraulic actuator in a remote locale, said hydraulic actuator adapted to operate when provided with a sufficient pressure, said system comprising:

a first hydraulic cylinder;

an isolated supply of fluid provided to said first hydraulic cylinder, said isolated supply of fluid positioned in an environment that is at a pressure other than atmospheric pressure;

an actuator device coupled to said first hydraulic cylinder, said actuator device positioned in said environment, said actuator device adapted to drive said first hydraulic cylinder to create said sufficient pressure in said fluid, wherein said actuator device is an electric motor and gear assembly; and at least one hydraulic line operatively intermediate said first hydraulic cylinder and said hydraulic actuator, said at least one hydraulic line supplying said sufficient pressure in said fluid to said hydraulic actuator in said remote locale.

15. A system for controlling a hydraulic actuator in a remote locale, said hydraulic actuator adapted to operate when provided with a sufficient pressure, said system comprising:

a first hydraulic cylinder;

an isolated supply of fluid provided to said first hydraulic cylinder, said isolated supply of fluid positioned in an environment that is at a pressure other than atmospheric pressure;

an actuator device coupled to said first hydraulic cylinder, said actuator device positioned in said environment, said actuator device adapted to drive said first hydraulic cylinder to create said sufficient pressure in said fluid;

at least one hydraulic line operatively intermediate said first hydraulic cylinder and said hydraulic actuator, said at least one hydraulic line supplying said sufficient pressure in said fluid to said hydraulic actuator in said remote locale;

a hydraulic fluid supply reservoir for storing a quantity of said supply of fluid, said fluid in said hydraulic fluid supply reservoir at a pressure that is less than said sufficient pressure; and an operation control valve in said at least one hydraulic line selectively positionable to put said hydraulic actuator in fluid communication with either of said first hydraulic cylinder and said hydraulic fluid supply reservoir.

16. A system for controlling a hydraulic actuator in a remote locale, said hydraulic actuator adapted to operate when provided with a sufficient pressure, said system comprising:

a first hydraulic cylinder;

an isolated supply of fluid provided to said first hydraulic cylinder, said isolated supply of fluid positioned in an environment that is at a pressure other than atmospheric pressure;

an actuator device coupled to said first hydraulic cylinder, said actuator device positioned in said environment, said actuator device adapted to drive said first hydraulic cylinder to create said sufficient pressure in said fluid;

at least one hydraulic line operatively intermediate said first hydraulic cylinder and said hydraulic actuator, said at least one hydraulic line supplying said sufficient pressure in said fluid to said hydraulic actuator in said remote locale;

wherein said first hydraulic cylinder comprises a movable pressure barrier, a first chamber and a second chamber, and wherein said first chamber is adapted to be in fluid communication with said supply of fluid, said second chamber is adapted to be selectably in fluid communication with said hydraulic actuator; and a bypass control valve selectively providing fluid communication between said first chamber and said second chamber.

17. A system for controlling a hydraulic actuator in a remote locale, said hydraulic actuator adapted to operate when provided with a sufficient pressure, said system comprising:

a first hydraulic cylinder;

an isolated supply of fluid provided to said first hydraulic cylinder, said isolated supply of fluid positioned in an environment that is at a pressure other than atmospheric pressure;

an actuator device coupled to said first hydraulic cylinder, said actuator device positioned in said environment, said actuator device adapted to drive said first hydraulic cylinder to create said sufficient pressure in said fluid;

at least one hydraulic line operatively intermediate said first hydraulic cylinder and said hydraulic actuator, said at least one hydraulic line supplying said sufficient pressure in said fluid to said hydraulic actuator in said remote locale;

a resupply line and a resupply coupling, said resupply coupling adapted to interface with an external source of fluid; and said resupply line being positioned intermediate said resupply coupling and said hydraulic supply reservoir.

18. A system for controlling a hydraulic actuator in a remote locale, said hydraulic actuator adapted to operate when provided with a sufficient pressure, said system comprising:

a first hydraulic cylinder;

an isolated supply of seawater provided to said first hydraulic cylinder, said isolated supply of fluid positioned in an environment that is at a pressure other than atmospheric pressure;

an actuator device coupled to said first hydraulic cylinder, said actuator device positioned in said environment, said actuator device adapted to drive said first hydraulic cylinder to create said sufficient pressure in said seawater; and at least one hydraulic line operatively intermediate said first hydraulic cylinder and said hydraulic actuator, said at least one hydraulic line supplying said sufficient pressure in said seawater to said hydraulic actuator in said remote locale.

19. A system for controlling a hydraulic actuator in a subsea well, comprising:

a first hydraulic cylinder;

an isolated subsea source of hydraulic fluid provided to said first hydraulic cylinder;

an actuator device positioned subsea and coupled to said first hydraulic cylinder, said actuator device adapted to drive said first hydraulic cylinder to pressurize said fluid;

at least one hydraulic line for supplying said pressurized fluid to said hydraulic actuator in said subsea well; and a downhole safety valve, wherein said hydraulic actuator in said subsea well comprises a single-acting hydraulic cylinder having an actuator piston and a return spring, said actuator piston being movable between a first position in which said downhole safety valve is open, and a second position in which said downhole safety valve is closed, said actuator piston being movable to said first position when said pressurized fluid is supplied to said single-acting hydraulic cylinder, and said actuator piston being movable to said second position by said return spring when said single-acting hydraulic cylinder is vented to thereby allow a pressure of said pressurized fluid to be reduced.

20. A system for controlling a hydraulic actuator in a subsea well, comprising:

a first hydraulic cylinder;

an isolated subsea source of hydraulic fluid provided to said first hydraulic cylinder;

an actuator device positioned subsea and coupled to said first hydraulic cylinder, said actuator device adapted to drive said first hydraulic cylinder to pressurize said fluid, wherein said actuator device comprises an electric motor; and at least one hydraulic line for supplying said pressurized fluid to said hydraulic actuator in said subsea well.

21. A system for controlling a hydraulic actuator in a subsea well, comprising:

a first hydraulic cylinder;

an isolated subsea source of hydraulic fluid provided to said first hydraulic cylinder;

an actuator device positioned subsea and coupled to said first hydraulic cylinder, said actuator device adapted to drive said first hydraulic cylinder to pressurize said fluid;

at least one hydraulic line for supplying said pressurized fluid to said hydraulic actuator in said subsea well; and a first control valve disposed between said hydraulic cylinder and said hydraulic actuator in said subsea well, said first control valve having at least a first position which allows said pressurized fluid to be supplied to said hydraulic actuator in said subsea well and a second position which vents said pressurized fluid in said hydraulic actuator in said subsea well to thereby reduce a pressure of said pressurized fluid.

22. A method of controlling a subsea hydraulic actuator, said hydraulic actuator adapted to operate when provided with a sufficient pressure, said method comprising:

providing an isolated subsea supply of fluid;

providing fluid from said isolated subsea supply of fluid to a first hydraulic cylinder that is actuated to create said sufficient pressure in said fluid, said first hydraulic cylinder being positioned subsea and being operatively connected to said hydraulic actuator by at least one hydraulic line;

communicating said sufficient pressure to said hydraulic actuator via said at least one hydraulic line; and resupplying fluid to said isolated supply of hydraulic fluid through a resupply line and a resupply coupling, said resupply coupling adapted to interface with an external source of hydraulic fluid, and said resupply line operatively intermediate said resupply coupling and said hydraulic supply reservoir.

23. The method of claim 22, further comprising:

filling said first hydraulic cylinder with a portion of said supply of hydraulic fluid by opening a bypass control valve selectively providing fluid communication between a first chamber and a second chamber of said first hydraulic cylinder, said first chamber in fluid communication with said supply of hydraulic fluid, and said second chamber in fluid communication with said hydraulic actuator.

24. A system for controlling a hydraulic actuator in a remote locale, said hydraulic actuator adapted to operate when provided with a sufficient pressure, said system comprising:

a first hydraulic cylinder;

an isolated supply of fluid provided to said first hydraulic cylinder, said isolated supply of fluid positioned in an environment that is at a pressure other than atmospheric pressure;

an actuator device coupled to said first hydraulic cylinder, said actuator device positioned in said environment, said actuator device adapted to drive said first hydraulic cylinder to create said sufficient pressure in said fluid;

at least one hydraulic line operatively intermediate said first hydraulic cylinder and said hydraulic actuator, said at least one hydraulic line supplying said sufficient pressure in said fluid to said hydraulic actuator in said remote locale; and a bypass control valve operatively connected to said first hydraulic cylinder to permit said actuator device to drive said first hydraulic cylinder without substantially increasing a pressure of said fluid.

* * * * *